US008316884B1

(12) United States Patent
England et al.

(10) Patent No.: US 8,316,884 B1
(45) Date of Patent: Nov. 27, 2012

(54) SAFETY DRAIN SYSTEM FOR FLUID RESERVOIR

(75) Inventors: John Dwight England, Arab, AL (US); Anthony R. Kelley, Somerville, AL (US); Raymond J. Cronise, Huntsville, AL (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 237 days.

(21) Appl. No.: 12/846,429

(22) Filed: Jul. 29, 2010

(51) Int. Cl.
*F16L 41/00* (2006.01)

(52) U.S. Cl. ..... 137/561 A; 137/575; 137/590; 137/599.01; 138/111

(58) Field of Classification Search ..... 137/266, 137/561 A, 571, 575, 590, 594, 599.01, 601.18; 138/115
See application file for complete search history.

(56) References Cited

U.S. PATENT DOCUMENTS

| | | | | | |
|---|---|---|---|---|---|
| 817,470 | A * | 4/1906 | Cole et al. | ..... | 73/861.65 |
| 872,103 | A * | 11/1907 | Aufrichtig | ..... | 435/291.1 |
| 2,045,598 | A * | 6/1936 | Hofmann | ..... | 425/67 |
| 2,288,297 | A * | 6/1942 | Naiman | ..... | 137/8 |
| 3,567,134 | A * | 3/1971 | Smith | ..... | 239/547 |
| 3,782,416 | A * | 1/1974 | Levin | ..... | 137/590 |
| 3,992,607 | A * | 11/1976 | Jolin | ..... | 392/449 |
| 4,341,050 | A * | 7/1982 | Long | ..... | 52/591.2 |
| 5,522,439 | A * | 6/1996 | Hakansson et al. | ..... | 141/244 |
| 5,924,456 | A * | 7/1999 | Simon | ..... | 138/122 |
| 6,692,037 | B1 * | 2/2004 | Lin | ..... | 285/124.1 |
| 2008/0223471 | A1 * | 9/2008 | Guo | ..... | 138/113 |

* cited by examiner

*Primary Examiner* — John Rivell
*Assistant Examiner* — R. K. Arundale
(74) *Attorney, Agent, or Firm* — Peter J. Van Bergen; James J. McGroary

(57) ABSTRACT

A safety drain system includes a plurality of drain sections, each of which defines distinct fluid flow paths. At least a portion of the fluid flow paths commence at a side of the drain section that is in fluid communication with a reservoir's fluid. Each fluid flow path at the side communicating with the reservoir's fluid defines an opening having a smallest dimension not to exceed approximately one centimeter. The drain sections are distributed over at least one surface of the reservoir. A manifold is coupled to the drain sections.

59 Claims, 3 Drawing Sheets

SAFETY DRAIN SYSTEM FOR FLUID RESERVOIR

ORIGIN OF THE INVENTION

The invention described herein was made in part by employees of the United States Government and may be manufactured and used by or for the Government of the United States of America for governmental purposes without the payment of any royalties thereon or therefor.

CROSS-REFERENCES TO RELATED APPLICATIONS

This patent application is co-pending with one related patent application entitled "SAFETY SYSTEM FOR CONTROLLING FLUID FLOW INTO A SUCTION LINE", Ser. No. 12/698,793, filed Feb. 2, 2010, by the same inventors and owned by the same assignee as this patent application.

BACKGROUND OF THE INVENTION

1. Field of the Invention

This invention relates to fluid reservoir drain systems. More specifically, the invention is a safety drain system that prevents injuries where the drain system interfaces with the fluid in the reservoir.

2. Description of the Related Art

Any large fluid-filled tank (e.g., pool, spa, mixing tank, storage tank, etc.) typically has at least one drain formed therein. Frequently, a suction line is coupled to the drain to facilitate removal of fluid from the tank. For example, pools and spas use pumps to continuously pull water through a drain and suction line as part of the water filtration process.

A problem with pool/spa drains (or any other tank drain that would encounter human interaction) is that human hair or extremities can become entrapped in a drain or suction line. Forces at these drains can be as much as several thousands of pounds. At these levels, human hair, fingers, toes, etc. can be violently sucked into the drain/suction line such that a person cannot free themselves from the drain/suction line. In the case of long hair, knots in the hair can readily form behind the drain as the turbulent flow of water moves through the drain and into the suction line. In the case of fingers, toes, etc., the violent sucking of the extremity can cause immediate injury thereto. If the suction force is confined to a small area (e.g., the connection point for a pool's vacuum line), a person's torso could provide a sufficient seal to the suction area thereby trapping the person thereat. Further, if such trapping occurs well under the water's surface, a person could be in danger of drowning. Still further, in extreme cases, intestinal disembowelment could occur if a person's rectal area were trapped over a drain/suction line.

SUMMARY OF THE INVENTION

Accordingly, it is an object of the present invention to provide a safety drain for a fluid reservoir.

Another object of the present invention is to provide a safety drain system that can distribute suction forces as fluid is drained from the reservoir.

Other objects and advantages of the present invention will become more obvious hereinafter in the specification and drawings.

In accordance with the present invention, a safety drain system includes a plurality of drain sections. Each drain section defines a plurality of distinct fluid flow paths with at least a portion of the fluid flow paths commencing at a side of the drain section that is in fluid communication with a reservoir's fluid. Each fluid flow path at the side communicating with the reservoir's fluid defines an opening having a smallest dimension not to exceed approximately one centimeter. The drain sections are distributed over at least one surface of the reservoir. A manifold is coupled to the drain sections to carry fluid exiting the reservoir through the drain sections.

BRIEF DESCRIPTION OF THE DRAWING(S)

Other objects, features and advantages of the present invention will become apparent upon reference to the following description of the preferred embodiments and to the drawings, wherein corresponding reference characters indicate corresponding parts throughout the several views of the drawings and wherein.

DESCRIPTION OF THE PREFERRED EMBODIMENT(S)

Figure 1:
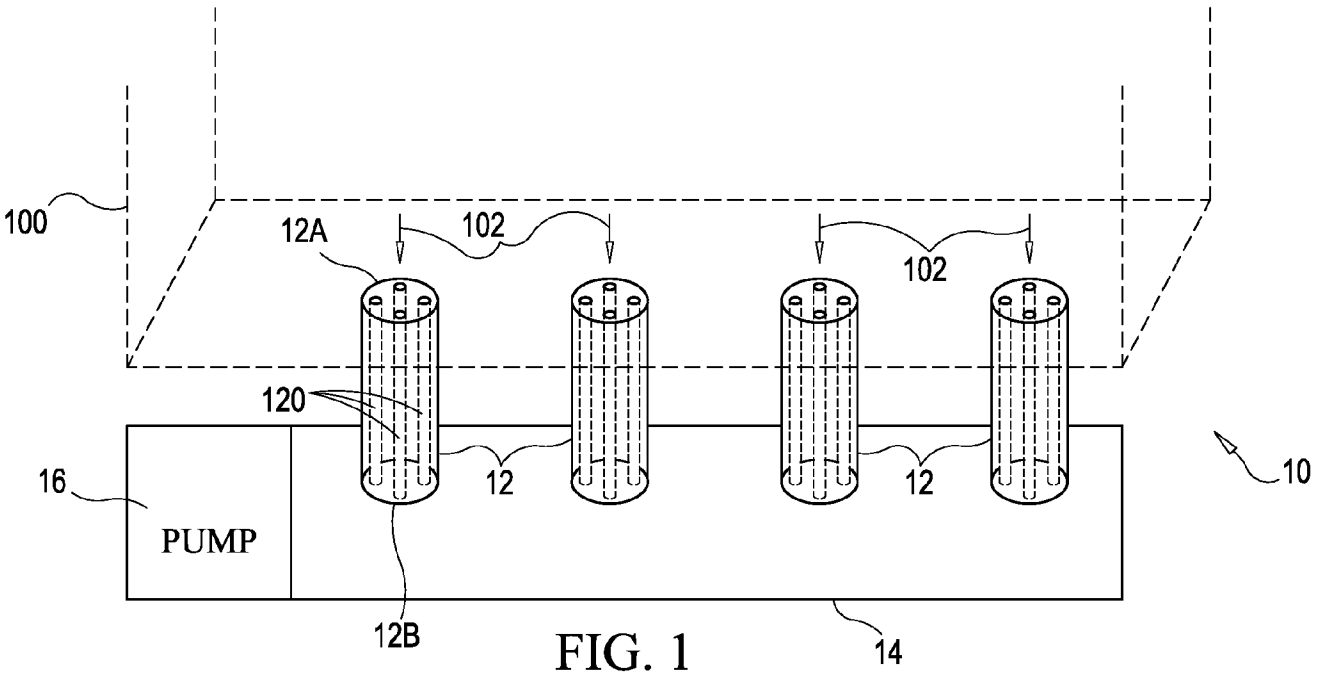
FIG. 1 is perspective view of a safety drain system in accordance with an embodiment of the present invention.

Referring now to the drawings and more particularly to FIG. 1, a safety drain system in accordance with an embodiment of the present invention is shown and is referenced generally by numeral 10. Drain system 10 is coupled to a fluid reservoir referenced by dashed lines 100 that can be representative of a swimming pool or any other tank/reservoir holding a fluid that must be drained therefrom occasionally, periodically, or constantly as part of a filtration or circulation process. Accordingly, it is to be understood that the type of fluid reservoir 100 and fluid contained thereby are not limitations of the present invention. Furthermore, the word "drain" as used herein refers to any withdrawal of fluid from a reservoir (e.g., near the top or along the sides of a reservoir for fluid recirculation as in a pool's skimmer, at the bottom of a reservoir as in a pool's drain, or both).

In the illustrated embodiment, drain system 10 includes a number of drain sections 12 leading from reservoir 100 (e.g., a bottom of reservoir 100) to a trunk line or manifold 14. Manifold 14 is sized to carry the entire volume of fluid exiting reservoir 100 via drain sections 12. In many applications, drain system 10 will include a pump 16 coupled to manifold 14 for generating a vacuum pressure in manifold 14 that draws fluid from reservoir 100 to and through drain sections 12 as indicated by arrow 102.

For ease of description, it will be assumed that each of drain sections 12 is the same. However, it is to be understood that a variety of drain sections 12 could be used in a particular drain system without departing from the scope of the present invention. Each drain section 12 defines a number of channels or paths 120 that lead from one side 12A to the other side 12B of drain section 12. Side 12A serves as the interface with the fluid in reservoir 100 and side 12B is in fluid communication with manifold 14. Each of paths 120 is distinct (i.e., closed between sides 12A and 12B) and defines an opening at sides 12A and 12B. That is, each path 120 defines a fluid flow path between reservoir 100 and manifold 14. The openings formed at side 12A should be small enough such that the smallest human extremity (e.g., finger, toe) cannot fit in any one opening. For most applications, this means that the smallest dimension (e.g., diameter in the case of circular opening) of an opening for a path 120 at side 12A should not exceed approximately one centimeter. The number of distinct paths 120 provided in a drain section 12 will be dependent on the number of drain sections used in drain system 10 and the volume of fluid that must be handled by drain system 10.

Another feature that can be provided by drain sections 12 is the length of path 120 as a mechanism for preventing entanglement of hair, clothing features (e.g., straps, drawstrings, etc.) etc. More specifically, if hair, straps, etc., were drawn into nearby distinct paths 120 at side 12A, the lengths of paths 120 could be utilized to prevent hair/strap entanglement at side 12B. This can be achieved in the vast majority of applications by making each flow path 120 approximately 3 feet (or longer) in length.

Drain sections 12 can also be used to minimize hair entanglement issues. Specifically, the number of flow paths 120 can be increased such that the flow turbulence and force necessary to draw in and entangle the hair at any localized group of paths 120 is sufficiently small to thereby prevent hair entanglement at side 12B.

Flow paths 120 can be straight and parallel to one another in their drain section 12. To shorten the overall length of a drain section, flow paths 120 could be spiraled or otherwise curved in drain section 12. Each drain section 12 could be made from a solid piece of material (e.g., plastic, composite, metal, etc.) with paths 120 formed therethrough. For example, each drain section 12 could be extruded with paths 120 being formed during such extrusion. Each drain section 12 could also be molded with paths 120 being formed during molding. Furthermore, each drain section 12 could be cut from a long length of extruded/molded material that incorporated paths 120. Still further, although drain sections 12 are illustrated as cylindrically shaped bodies, other geometric configurations could be used without departing from the scope of the present invention.

Figure 2:
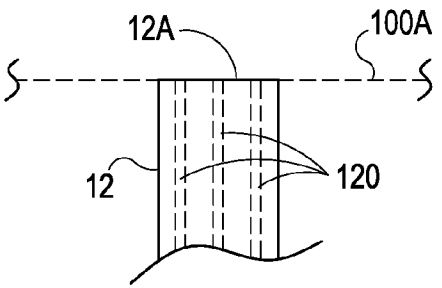
FIG. 2 is an isolated side view of a drain section having a flat side where it interfaces with a surface of a reservoir in which it is installed.
Figure 3:
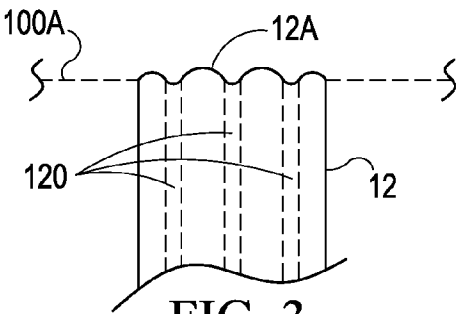
FIG. 3 is an isolated side view of a drain section having a contoured side where it interfaces with a surface of a reservoir in which it is installed.

The surface of drain section 12 defined at side 12A thereof could be flat or planar and coincident with the surface 100A of reservoir 100 as illustrated in the isolated view of a drain section 12 shown in FIG. 2. Another option is to contour (e.g., undulate) side 12A as illustrated in FIG. 3 such that the openings of paths 120 at side 12A occur in the valleys of such contours. In this way, the openings of paths 120 at side 12A are not as readily covered by a person's body part (not shown) coming into contact with side 12A.

Figure 4:
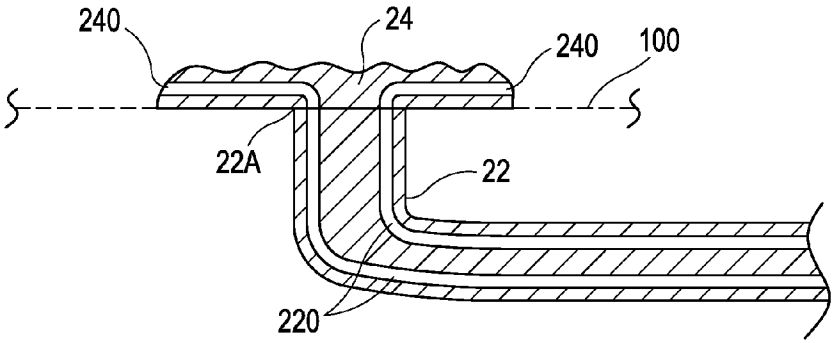
FIG. 4 is an isolated cross-sectional view of a curved drain section having a cap attached thereto in accordance with another embodiment of the present invention.

Although the drain section embodiment described thus far utilizes straight drain sections, the present invention is not so limited. For example, FIG. 4 illustrates a curved drain section 22 with multiple curved distinct flow paths 220 formed therethrough. For ease of illustration, only two such flow paths 220 are shown. As in the previous embodiment, the openings of paths 220 at side 22A would have a smallest dimension less than approximately one centimeter if side 22A interfaces with the fluid reservoir 100. However, in this embodiment, a cap 24 is coupled to side 22A and serves as the interface with the fluid in reservoir 100. Cap 24 defines a number of channels 240 commensurate with the number of paths 220 in drain section 22. Cap 24 is configured such that one of its channels 240 aligns with one of paths 220 in drain section 22. Cap 24 can also be configured such that each of channels 240 leads to a peripheral location on cap 24. In this way, the open side of channels 240 can be distributed over an area that is larger than most or all of human body parts that might come into contact with cap 24. The top of cap 24 could be flat or contoured (as shown). Each of channels 240 could also be configured to span over a number of paths 220 without departing from the scope of the present invention.

The previous embodiments of the present invention utilize drain sections that can be distributed/dispersed at spaced apart locations on one or more surfaces (e.g., bottom and/or sides) of a fluid reservoir. However, the present invention is not so limited as multiple drain sections could be configured for arrangements in contiguous patterns thereof. An exemplary embodiment of one such drain section and drain system constructed therefrom will be described herein with the aid of FIGS. 5-9.

Figure 5:
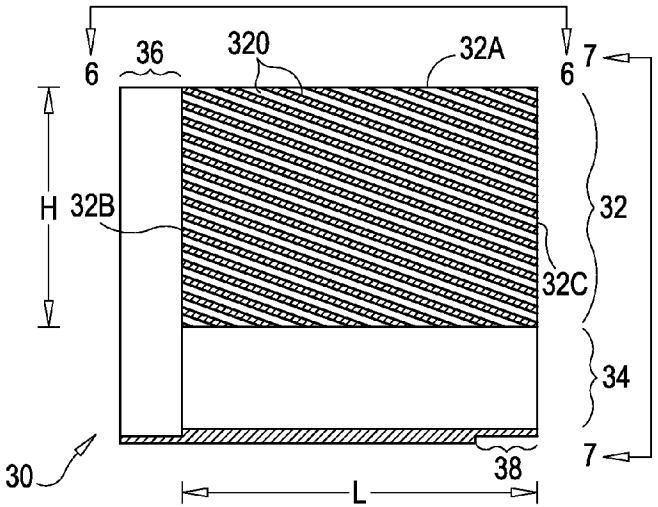
FIG. 5 is a cross-sectional view of a modular drain section in accordance with another embodiment of the present invention.
Figure 7:
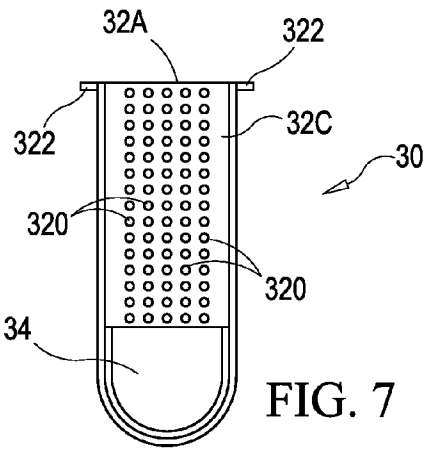
FIG. 7 is an end view of the drain section in FIG. 5 taken along line 7-7 thereof.
Figure 6:
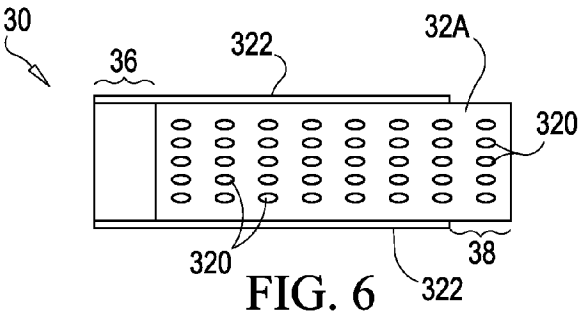
FIG. 6 is a top view of the drain section in FIG. 5 taken along line 6-6 thereof.

Referring now to FIGS. 5-7, a single modular drain section in accordance with another embodiment of the present invention is shown and is referenced generally by numeral 30. The cross-sectional view (FIG. 5), top view (FIG. 6), and end view (FIG. 7) will be referred to simultaneously. Drain section 30 can be made a single integrated unit (e.g., one-piece molded construction) or could be fabricated as an assembly without departing from the scope of the present invention. In either case, drain section 30 has a flow path region 32 and a manifold region 34 adjoining and coupled to flow path region 32. Opposing ends of the combination of regions 32 and 34 are configured to permit the coupling of additional drain sections 30 to either end thereof as will be explained later below.

Flow path region 32 defines a number of parallel and distinct flow paths 320, some of which begin as openings at a top side 32A of flow path region 32. Each such opening of a flow path 320 at side 32A should have its smallest dimension (e.g., diameter) not exceed approximately one centimeter. The number of flow paths 320 is not a limitation of the present invention. Top side 32A will form the interface with the fluid in a reservoir (not shown), and can define a flat/planar surface or contoured surface without departing from the scope of the present invention. Tabs 322 extending out from side 32A can be provided to facilitate placement of drain section 30 at a grade level if drain section 30 is to be installed during construction of a fluid reservoir.

Flow paths 320 form an acute angle with side 32A. This angle along with the overall length "L" and height "H" of flow path region 32 determines where each flow path 320 exits region 32. However, it is to be understood that the choice of angle, length L and height H do not limit the scope of the present invention. For example, in the illustrated embodiment, none of the flow paths 320 originating at top side 32A exit flow path region 32 into manifold region 34 as they exit an end 32C thereof. (Note that a larger acute angle could be selected if it was desired to have some of the flow paths originating at top side 32A exit region 32 into manifold region 34.) Further in the illustrated example, others of flow paths 320 originate at an end 32B (opposing end 32C) and exit flow path region 32 in manifold region 34.

Although not shown in this embodiment, the length of a flow path 320 extending from top side 32A to manifold region 34 can be approximately 3 feet in length to avoid entanglement issues as described for the previous embodiment. However, an advantage of this modular embodiment is that each flow path 320 can be much less than 3 feet in length since it is intended to couple multiple drain sections 30 together as will be explained further below.

One end of drain section 30 terminates in a receiver 36 while opposing end of drain section 30 has the combination of regions 32/34 defining a region 38 designed to nest in a receiver 36 of an adjoining drain section. Thus, a number of drain sections 30 configured identically in the above-described fashion can be assembled as a drain section assembly that forms part of a drain system.

Figure 8:
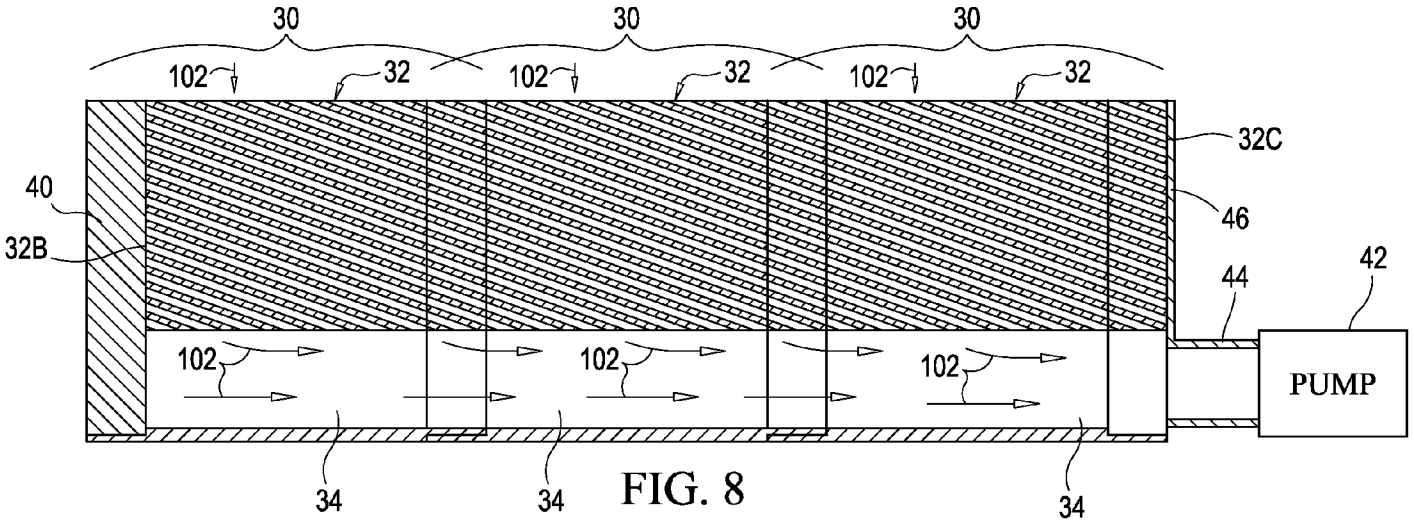
FIG. 8 is a cross-sectional view of three modular drain sections coupled together as part of a safety drain system in accordance with another embodiment of the present invention.

Referring now to FIG. 8, an embodiment of a drain system constructed from drain sections 30 is illustrated. To maintain the clarity in FIG. 8 while facilitating an understanding of the drain system in FIG. 8, continued reference to FIGS. 5-7 will be employed with respect to drain section details. In this embodiment, three of drain sections 30 are used. However, it is to be understood that the number of drain sections 30 coupled together is not a limitation of the present invention. The last drain section 30 (i.e., leftmost one in FIG. 8) has an end cap 40 coupled thereto (e.g., fitted in receiver 36 of the leftmost drain section 30) to effectively seal off its manifold region 34 and flow paths 320 originating at its end 32B. Since each drain section 30 is identical, flow paths 320 exiting a side 32C of one drain section 30 align with flow paths 320 originating at a side 32B of an adjoining drain section 30. Thus, the length of a flow path in the drain system could be defined by several of drain sections 30 thereby allowing this embodiment to develop relatively long (i.e., longer than 3 feet) flow paths in the drain system. The adjoining manifold regions 34 of individual drain sections 30 are also joined to form a continuous manifold of the drain system.

The first drain section 30 (i.e., rightmost one in FIG. 8) in the line of coupled drain sections has its manifold region 34 coupled to a pump 42 via, for example, a conduit 44. A second end cap 46 is used to seal flow paths 320 exiting end 32C of this first drain section 30. When pump 42 is operated to develop a vacuum pressure in the adjoining manifold regions 34, fluid in a reservoir (not shown) is drawn through flow path regions 32 and into/through manifold regions 34 as indicated by flow arrows 102.

Figure 9:
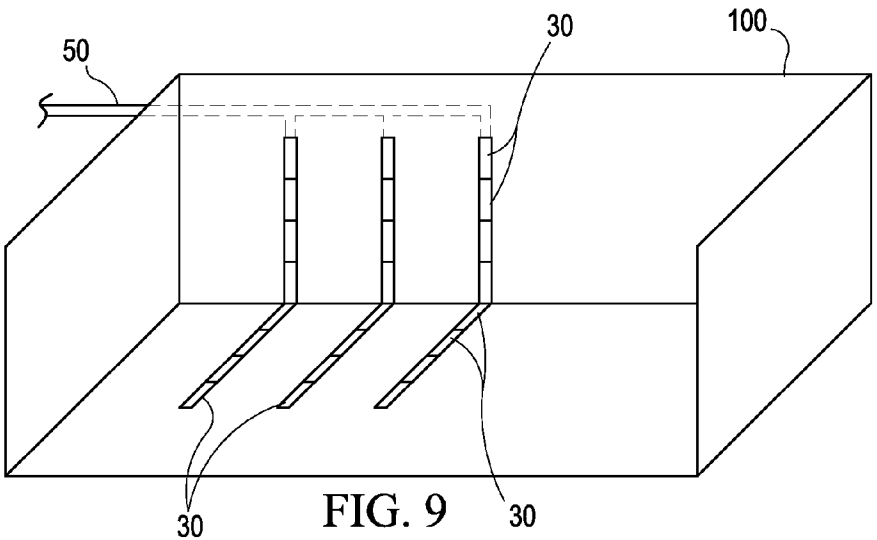
FIG. 9 is a perspective view of a safety drain system having contiguous patterns of drain sections on both the side and bottom of a fluid reservoir in accordance with another embodiment of the present invention.

The embodiment just described can be used to form a drain system that interfaces with the fluid in a reservoir along one or multiple surfaces of the reservoir (e.g., along just the bottom surface of a reservoir, along just one or more side surfaces of a reservoir, or along both bottom and side surfaces of a reservoir). By way of example, FIG. 9 illustrates a safety drain system using three "lines" of coupled drain sections 30 where each such line of drain sections 30 extends along the bottom surface of reservoir 100 and a side surface of reservoir 100. A single suction line 50 can be coupled to the adjoining drain sections 30. If suction line 50 is coupled to the topmost drain section 30 in each "line" (as shown), the safety drain system is configured for recirculation. For pure drainage, suction line 50 would be coupled to a drain section 30 located along the bottom of reservoir 100. By distributing the drain openings in this fashion, the vacuum pressure at any one drain opening (or even multiples thereof) is not sufficient to hold a body part against a drain section. Further, by providing one or more drain sections 30 along a side of reservoir 100, problems associated with the settling of solids on a reservoir's bottom drain are virtually eliminated since a good portion of the drain system will always remain unobstructed.

The advantages of the present invention are numerous. The safety drain system utilizes small drain openings, long/distinct fluid flow paths, and drain opening distribution to virtually eliminate the dangerous suction forces and hair/garment entanglement issues associated with conventional drain systems. The safety drain system will be especially useful in recreational pools to protect unassuming swimmers. The present invention will also improve safety in training pools where swimmers are often encumbered with lots of equipment and/or clothing, and can be distracted by attempting to accomplish a task at hand.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A drain system for a fluid reservoir, comprising:

a plurality of drain sections with each drain section from said plurality thereof defining a plurality of distinct fluid flow paths therethrough with at least a portion of said fluid flow paths commencing at a side of said drain section adapted to be in fluid communication with a fluid in a reservoir, wherein each of said fluid flow paths at said side defines an opening having a smallest dimension not to exceed approximately one centimeter, said plurality of drain sections adapted to be distributed over at least one surface of the reservoir;

a cap coupled to each said side of said drain section, said cap defining a plurality of flow openings corresponding to said fluid flow paths commencing at said side wherein, when said cap is coupled to said drain section, each of said flow openings is in fluid communication with a unique one of said fluid flow paths commencing at said side, wherein said flow openings are distributed about a periphery of said cap and a manifold coupled to said plurality of drain sections and adapted to carry fluid exiting the reservoir through said plurality of drain sections.

2. A drain system as in claim 1, wherein said sides associated with said plurality of drain sections are arranged in a discontinuous pattern over the at least one surface of the reservoir.

3. A drain system as in claim 1, wherein each of said drain sections comprises a solid piece of material with said fluid flow paths formed therethrough.

4. A drain system as in claim 1, wherein each of said drain sections comprises an extruded piece of material with said fluid flow paths formed therethrough.

5. A drain system as in claim 1, wherein each of said drain sections comprises a molded piece of material with said fluid flow paths formed therethrough.

6. A drain system as in claim 1, wherein said plurality of drain sections are located along at least one of (i) a bottom of the reservoir, (ii) at least one side of the reservoir, and (iii) a bottom of the reservoir and at least one side of the reservoir.

7. A drain system as in claim 1, wherein each of said fluid flow paths is at least approximately 3 feet in length.

8. A drain system as in claim 1, wherein said side of said drain section is coincident with the at least one surface of the reservoir.

9. A drain system as in claim 1, wherein said side of said drain section is planar.

10. A drain system as in claim 1, wherein a top of said cap is contoured.

11. A drain system as in claim 1, further comprising a pump coupled to said manifold for developing a vacuum pressure therein.

12. A drain system as in claim 1, wherein said fluid flow paths are parallel to one another in each of said drain sections.

13. A drain system for a fluid reservoir, comprising:

a plurality of drain sections with each drain section from said plurality thereof defining a plurality of distinct and parallel fluid flow paths therethrough with at least a portion of said fluid flow paths commencing at a side of said drain section adapted to be in fluid communication with a fluid in a reservoir, wherein each of said fluid flow paths at said side defines an opening having a smallest dimension not to exceed approximately one centimeter, said plurality of drain sections adapted to be distributed over multiple surfaces of the reservoir to include at least one of (i) a bottom of the reservoir, (ii) at least one side of the reservoir, and (iii) a bottom of the reservoir and at least one side of the reservoir;

a cap coupled to each said side of said drain section, said cap defining a plurality of flow openings corresponding to said fluid flow paths commencing at said side wherein, when said cap is coupled to said drain section, each of said flow openings is in fluid communication with a unique one of said fluid flow paths commencing at said side, wherein said flow openings are distributed about a periphery of said cap a manifold coupled to said plurality of drain sections and adapted to carry fluid exiting the reservoir through said plurality of drain sections; and a pump coupled to said manifold for developing a vacuum pressure therein.

14. A drain system as in claim 13, wherein each of said drain sections comprises a solid piece of material with said fluid flow paths formed therethrough.

15. A drain system as in claim 13, wherein each of said drain sections comprises an extruded piece of material with said fluid flow paths formed therethrough.

16. A drain system as in claim 13, wherein each of said drain sections comprises a molded piece of material with said fluid flow paths formed therethrough.

17. A drain system as in claim 13, wherein each of said fluid flow paths is at least approximately 3 feet in length.

18. A drain system as in claim 13, wherein said side of said drain section is coincident with one of the multiple surfaces of the reservoir.

19. A drain system as in claim 13, wherein said side of said drain section is planar.

20. A drain system as in claim 13, wherein a top of said cap is contoured.

21. A drain system for a fluid reservoir, comprising:

a plurality of drain sections with each drain section from said plurality thereof defining a plurality of distinct fluid flow paths therethrough with at least a portion of said fluid flow paths commencing at a side of said drain section adapted to be in fluid communication with a fluid in a reservoir, said side of said drain section undulating to define a plurality of valleys with each of said fluid flow paths commencing in one of said valleys, wherein each of said fluid flow paths at said side defines an opening having a smallest dimension not to exceed approximately one centimeter, said plurality of drain sections adapted to be distributed over at least one surface of the reservoir; and a manifold coupled to said plurality of drain sections and adapted to carry fluid exiting the reservoir through said plurality of drain sections.

22. A drain system as in claim 21, wherein said sides associated with said plurality of drain sections are arranged in a discontinuous pattern over the at least one surface of the reservoir.

23. A drain system as in claim 21, wherein said sides associated with said plurality of drain sections are arranged in at least one contiguous pattern wherein said contiguous pattern is defined by at least two adjacent ones of said sides.

24. A drain system as in claim 21, wherein each of said drain sections comprises a solid piece of material with said fluid flow paths formed therethrough.

25. A drain system as in claim 21, wherein each of said drain sections comprises an extruded piece of material with said fluid flow paths formed therethrough.

26. A drain system as in claim 21, wherein each of said drain sections comprises a molded piece of material with said fluid flow paths formed therethrough.

27. A drain system as in claim 21, wherein said plurality of drain sections are located along at least one of (i) a bottom of the reservoir, (ii) at least one side of the reservoir, and (iii) a bottom of the reservoir and at least one side of the reservoir.

28. A drain system as in claim 21, wherein each of said fluid flow paths is at least approximately 3 feet in length.

29. A drain system as in claim 21, wherein said side of said drain section is coincident with the at least one surface of the reservoir.

30. A drain system as in claim 21, wherein each said drain section is of modular construction to permit coupling of multiple ones of said drain sections, wherein some of said fluid flow paths commencing at said side of one said drain section are in fluid communication with some of said fluid flow paths from said another of said drain sections coupled thereto.

31. A drain system as in claim 21, further comprising a pump coupled to said manifold for developing a vacuum pressure therein.

32. A drain system as in claim 21, wherein said fluid flow paths are parallel to one another in each of said drain sections.

33. A drain system for a fluid reservoir, comprising:

a plurality of drain sections with each drain section from said plurality thereof defining a plurality of distinct and parallel fluid flow paths therethrough with at least a portion of said fluid flow paths commencing at a side of said drain section adapted to be in fluid communication with a fluid in a reservoir, said side of said drain section undulating to define a plurality of valleys with each of said fluid flow paths commencing in one of said valleys, wherein each of said fluid flow paths at said side defines an opening having a smallest dimension not to exceed approximately one centimeter, said plurality of drain sections adapted to be distributed over multiple surfaces of the reservoir to include at least one of (i) a bottom of the reservoir, (ii) at least one side of the reservoir, and (iii) a bottom of the reservoir and at least one side of the reservoir;

a manifold coupled to said plurality of drain sections and adapted to carry fluid exiting the reservoir through said plurality of drain sections; and a pump coupled to said manifold for developing a vacuum pressure therein.

34. A drain system as in claim 33, wherein said sides associated with said plurality of drain sections are arranged in at least one contiguous pattern wherein said contiguous pattern is defined by at least two adjacent ones of said sides.

35. A drain system as in claim 33, wherein each of said drain sections comprises a solid piece of material with said fluid flow paths formed therethrough.

36. A drain system as in claim 33, wherein each of said drain sections comprises an extruded piece of material with said fluid flow paths formed therethrough.

37. A drain system as in claim 33, wherein each of said drain sections comprises a molded piece of material with said fluid flow paths formed therethrough.

38. A drain system as in claim 33, wherein each of said fluid flow paths is at least approximately 3 feet in length.

39. A drain system as in claim 33, wherein said side of said drain section is coincident with one of the multiple surfaces of the reservoir.

40. A drain system as in claim 33, wherein each said drain section is of modular construction to permit coupling of multiple ones of said drain sections, wherein some of said fluid flow paths commencing at said side of one said drain section are in fluid communication with some of said fluid flow paths from said another of said drain sections coupled thereto.

41. A drain system for a fluid reservoir, comprising:

a plurality of drain sections with each drain section from said plurality thereof defining a plurality of distinct fluid flow paths therethrough with at least a portion of said fluid flow paths commencing at a side of said drain section adapted to be in fluid communication with a fluid in a reservoir, wherein each of said fluid flow paths at said side defines an opening having a smallest dimension not to exceed approximately one centimeter, said plurality of drain sections adapted to be distributed over at least one surface of the reservoir;

each said drain section being of modular construction to permit coupling of multiple ones of said drain sections, wherein some of said fluid flow paths commencing at said side of one said drain section are in fluid communication with some of said fluid flow paths from said another of said drain sections coupled thereto; and a manifold coupled to said plurality of drain sections and adapted to carry fluid exiting the reservoir through said plurality of drain sections.

42. A drain system as in claim 41, wherein said sides associated with said plurality of drain sections are arranged in at least one contiguous pattern wherein said contiguous pattern is defined by at least two adjacent ones of said sides.

43. A drain system as in claim 41, wherein each of said drain sections comprises a solid piece of material with said fluid flow paths formed therethrough.

44. A drain system as in claim 41, wherein each of said drain sections comprises an extruded piece of material with said fluid flow paths formed therethrough.

45. A drain system as in claim 41, wherein each of said drain sections comprises a molded piece of material with said fluid flow paths formed therethrough.

46. A drain system as in claim 41, wherein said plurality of drain sections are located along at least one of (i) a bottom of the reservoir, (ii) at least one side of the reservoir, and (iii) a bottom of the reservoir and at least one side of the reservoir.

47. A drain system as in claim 41, wherein each of said fluid flow paths is at least approximately 3 feet in length.

48. A drain system as in claim 41, wherein said side of said drain section is coincident with the at least one surface of the reservoir.

49. A drain system as in claim 41, wherein said side of said drain section is planar.

50. A drain system as in claim 41, further comprising a pump coupled to said manifold for developing a vacuum pressure therein.

51. A drain system as in claim 41, wherein said fluid flow paths are parallel to one another in each of said drain sections.

52. A drain system for a fluid reservoir, comprising:

a plurality of drain sections with each drain section from said plurality thereof defining a plurality of distinct and parallel fluid flow paths therethrough with at least a portion of said fluid flow paths commencing at a side of said drain section adapted to be in fluid communication with a fluid in a reservoir, wherein each of said fluid flow paths at said side defines an opening having a smallest dimension not to exceed approximately one centimeter, said plurality of drain sections adapted to be distributed over multiple surfaces of the reservoir to include at least one of (i) a bottom of the reservoir, (ii) at least one side of the reservoir, and (iii) a bottom of the reservoir and at least one side of the reservoir;

each said drain section being of modular construction to permit coupling of multiple ones of said drain sections, wherein some of said fluid flow paths commencing at said side of one said drain section are in fluid communication with some of said fluid flow paths from said another of said drain sections coupled thereto;

a manifold coupled to said plurality of drain sections and adapted to carry fluid exiting the reservoir through said plurality of drain sections; and a pump coupled to said manifold for developing a vacuum pressure therein.

53. A drain system as in claim 52, wherein said sides associated with said plurality of drain sections are arranged in at least one contiguous pattern wherein said contiguous pattern is defined by at least two adjacent ones of said sides.

54. A drain system as in claim 52, wherein each of said drain sections comprises a solid piece of material with said fluid flow paths formed therethrough.

55. A drain system as in claim 52, wherein each of said drain sections comprises an extruded piece of material with said fluid flow paths formed therethrough.

56. A drain system as in claim 52, wherein each of said drain sections comprises a molded piece of material with said fluid flow paths formed therethrough.

57. A drain system as in claim 52, wherein each of said fluid flow paths is at least approximately 3 feet in length.

58. A drain system as in claim 52, wherein said side of said drain section is coincident with one of the multiple surfaces of the reservoir.

59. A drain system as in claim 52, wherein said side of said drain section is planar.

* * * * *